US006360795B1

(12) United States Patent
Bothe et al.

(10) Patent No.: US 6,360,795 B1
(45) Date of Patent: Mar. 26, 2002

(54) DEVICE AND ARRANGEMENT FOR FILLING AN INK RESERVOIR

(75) Inventors: Thomas Bothe, Nürnberg; Anke Müller, Bayreuth; Günther Tandler, Oberasbach; Klaus Fischbäck, Nürnberg, all of (DE)

(73) Assignee: J. S. Staedtler GmbH & Co., Nuremberg (DE)

( * ) Notice: Subject to any disclaimer, the term of this patent is extended or adjusted under 35 U.S.C. 154(b) by 0 days.

(21) Appl. No.: 09/531,140

(22) Filed: Mar. 17, 2000

(30) Foreign Application Priority Data

Mar. 22, 1999 (DE) ..... 199 12 620

(51) Int. Cl.[7] ..... B65B 3/00

(52) U.S. Cl. ..... 141/346; 141/18; 141/348; 141/351

(58) Field of Search ..... 141/2, 18, 20.5, 141/346, 347, 348, 349, 351, 352, 353, 359, 360

(56) References Cited

U.S. PATENT DOCUMENTS 4,829,002 A * 5/1989 Pattillo et al. ..... 435/284
5,546,979 A * 8/1996 Clark, II et al. ..... 137/318
5,732,751 A * 3/1998 Schmidt et al. ..... 141/48

* cited by examiner

*Primary Examiner*—Gregory L. Huson
*Assistant Examiner*—Peter deVore
(74) *Attorney, Agent, or Firm*—Friedrich Kueffner

(57) ABSTRACT

A refill arrangement for an ink reservoir of an automatic writing system has an ink reservoir, an adaptor, and a refill container provided as individual parts and to be combined for filling the ink reservoir such that the adaptor connects the refill container to the ink reservoir and such that the refill container, the adaptor, and the ink reservoir are hermetically sealed relative to the ambient atmosphere when connected. The refill container is positioned vertically above the ink reservoir in a filling position of the refill arrangement. The refill arrangement operates pressureless or by gravity feed. The adaptor has a housing, a first connector arranged in the housing for receiving a connecting piece of the ink reservoir and a second connector arranged in the housing for receiving a connecting piece of the refill container. The housing has a filling channel connecting the first and second connectors. The adaptor has a valve stop and seals that seal the connecting pieces in the respective first and second connectors during filling.

18 Claims, 3 Drawing Sheets

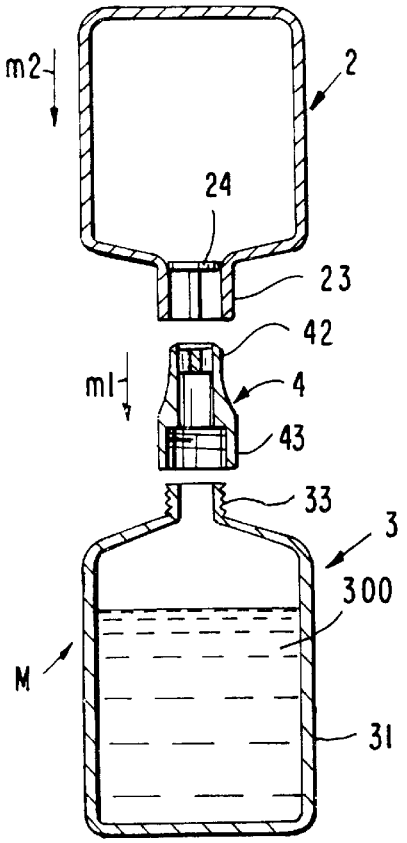
FIG. 4
FIG. 5
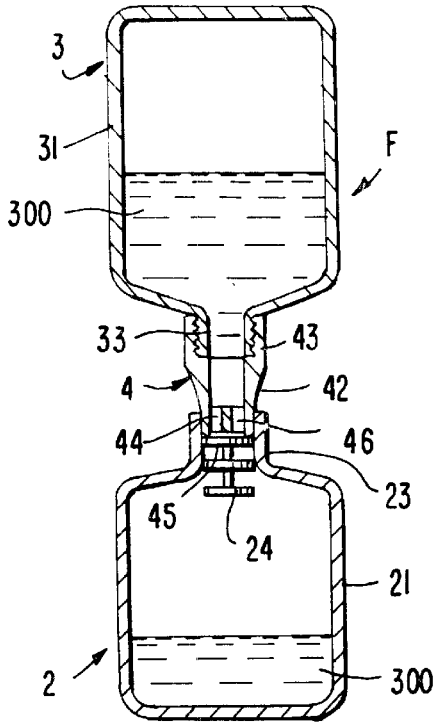
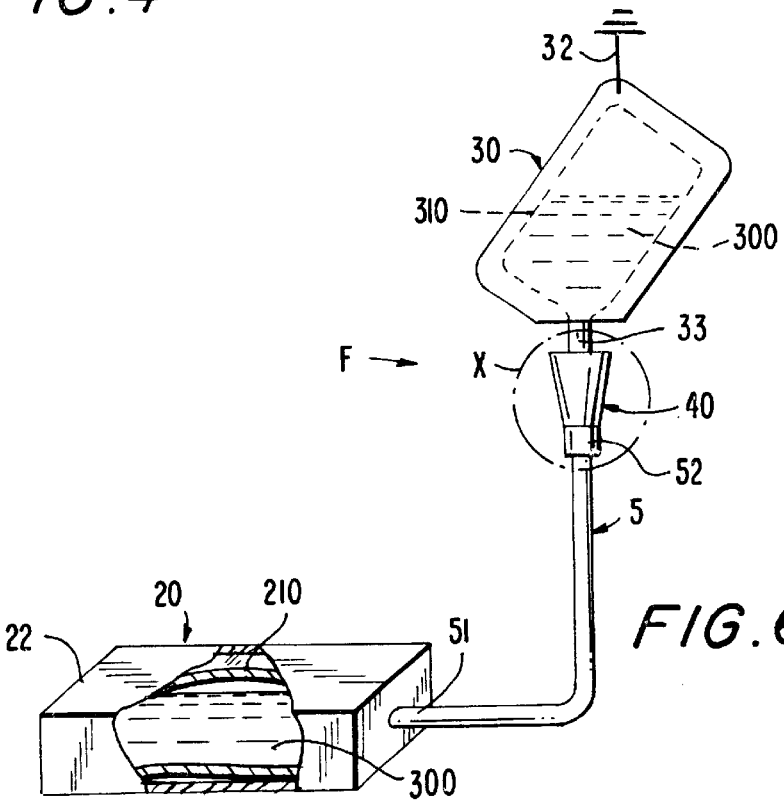
FIG. 6

DEVICE AND ARRANGEMENT FOR FILLING AN INK RESERVOIR

BACKGROUND OF THE INVENTION

1. Field of the Invention

The invention relates to a device and an arrangement for filling an ink reservoir, especially a refill device and arrangement for filling ink reservoirs of inkjet systems and plotters or other automatic recording, writing, or drawing devices.

2. Description of the Related Art

Refill devices for filling containers or ink reservoirs are known. For example, refill systems exist for filling ink reservoirs of inkjet systems and plotters and for other automatic recording, writing, or drawing devices. These refill systems make it possible to refill empty ink reservoirs of the write heads or printheads or of the recording pens with new ink or other recording media.

From U.S. Pat. No. 5,595,223 an ink refill arrangement is known in which an adaptor is provided that is seated on a printhead. With the aid of the adaptor, on the one hand, the ink reservoir of the printhead, for which the suggested device and arrangement are to be used, can be opened and a refill container can be placed thereon, punctured and fastened. Upon opening or puncturing the container, the closure parts are released or destroyed so that the ink can then flow from the container into the reservoir. Air compensation in the reservoir to be filled, and via the reservoir also in the refill container, is realized by air channels which open into the ambient atmosphere. For filling the reservoir, the refill container must be arranged above or on top of the adaptor so that the ink can flow by gravity feed automatically from the container into the reservoir.

In the case of unfavorable filling positions, over filling, for example, when the refill container contains more ink than the reservoir can hold, or tipping over of the filling arrangement, it is possible that ink may leak from the system via the air channels, i.e., via the connection to the atmosphere, so that considerable soiling can result.

In U.S. Pat. No. 5,719,610 and international application WO 98/55318 ink systems are disclosed which comprise containers and/or reservoirs with valves for releasing or receiving ink. When coupling the corresponding parts to one another, the valves are opened so that ink can flow. However, this requires very complex and very expensive couplings and valves so that these systems are relatively expensive. Moreover, only containers or system parts can be connected to one another whose coupling areas are designed for mutual coupling from the beginning and are accordingly matched to one another.

Furthermore, refill containers that are pressurized or refill devices or systems which operate with pressure are also in use. Such devices are, for example, disclosed and described in German patent documents DE 30 24 678 C2 and DE 30 41 277 C2. These known devices or systems have the disadvantage that an increased soiling risk for the entire system is present at the connectors or leaky locations because of the pressure in the system. Moreover, pressure or a suitable pressure medium must be generated when needed, or maintained at all times and supplied when needed, and must therefore be reliably sealed so that the entire system is also complicated and expensive.

With many of the newer conventional systems and devices a simple and clean refilling of ink reservoirs, especially directly on site and performed by the user, has not been possible without requiring a complex device or machine because a so-called closed system is required in most cases.

SUMMARY OF THE INVENTION

It is an object of the present invention to provide a simple, clean, and inexpensive refill system with which two containers and/or reservoirs can be connected, for the purpose of an easy filling of an ink or other writing medium container and/or reservoir, on inkjet printers, plotters, or other automatic recording, writing, printing, or drawing devices, if possible by the user himself and/or by employing closed systems.

In accordance with the present invention, this is achieved according to a first embodiment in that the ink reservoir, the refill container, and the adaptor are separate individual parts, that the ink reservoir, the refill container, and the adaptor in the assembled state provide a hermetically closed system that has no connection to the atmosphere, that the refill container in the filling position is positioned vertically above the ink reservoir, and that in the filling position the filling process takes place pressureless or by gravity feed.

In accordance with the present invention, the object is achieved according to a second embodiment in that the adaptor has a housing and at least one reservoir connector and a container connector respectively for the refill container and the reservoirs to be connected, in that at least one filling channel and a valve stop are arranged, that seals are provided which in the filling position, respectively, during refilling, tightly seal the reservoir connecting piece or the reservoir connecting piece provided on a closure valve and the container connecting piece.

In accordance with the present invention, the object is achieved according to a third embodiment in that the adaptor is a separate individual part and that the refill container in the filling position is arranged substantially above the i fill level of the ink reservoir.

In the context of the invention, the term writing system is meant to include all types of automatic systems, as specified in an exemplary fashion supra, that apply ink to a surface for the purpose of creating letters, numbers, characters, images etc.

BRIEF DESCRIPTION OF THE DRAWING

In the drawing:

FIG. 4 is a first refill arrangement according to the invention in the assembly stage before the filling process takes place;

FIG. 5 shows the first refill arrangement according to FIG. 4 in the filling position;

FIG. 6 shows a second embodiment of a refill arrangement according to the present invention in the filling position;

DESCRIPTION OF THE PREFERRED EMBODIMENTS

Figure 1:
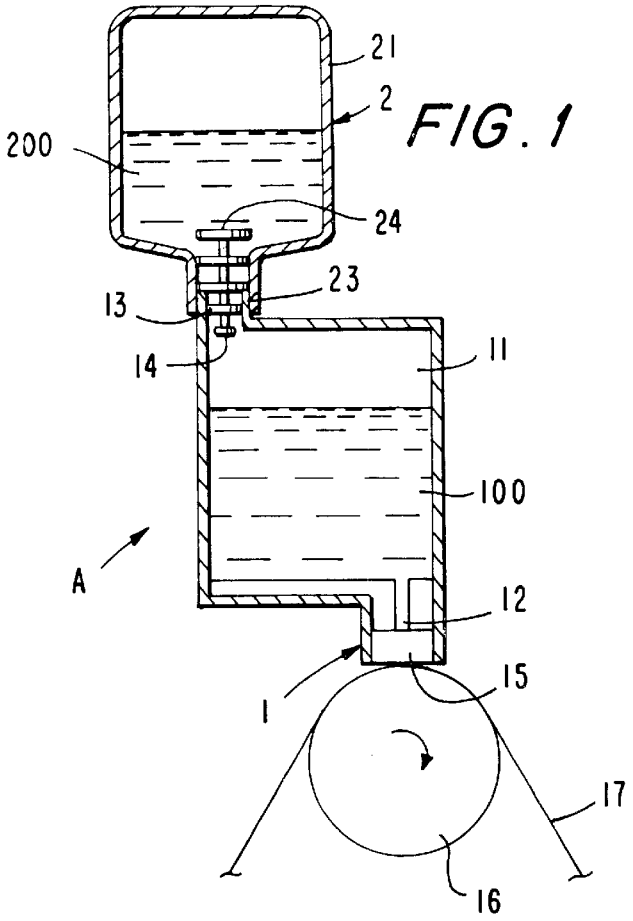
FIG. 1 shows a write head with ink reservoir for which the device and arrangement according to the invention are to be used.

The FIG. 1 shows a write head 1 with an ink reservoir 2 in the working position A. The device and arrangement according to the invention are to be used with such a write head. The continuous foil or paper 17 to be printed or written on is transported on the transport roller 16 of a plotter or printer (not shown in detail) in accordance with the progress of the printing/writing job.

The ink 100 contained in the ink reservoir 11 is supplied via an ink guide 12, embodied as a jet, to the writing element 15 which applies the ink to the continuous paper sheet 17. An additional ink reservoir 2 is connected in an airtight manner to the fill connector 13 of the ink reservoir 11 provided with an inlet valve 14. The reservoir housing 21 also contains ink, respectively, writing or coloring media 200 which, when needed, can flow in a controlled fashion via the fill valve 24 and/or the inlet valve 14, which can be controlled together or individually and can be mechanically or electrically opened and closed, into the substantially empty ink reservoir 11.

Figure 2:
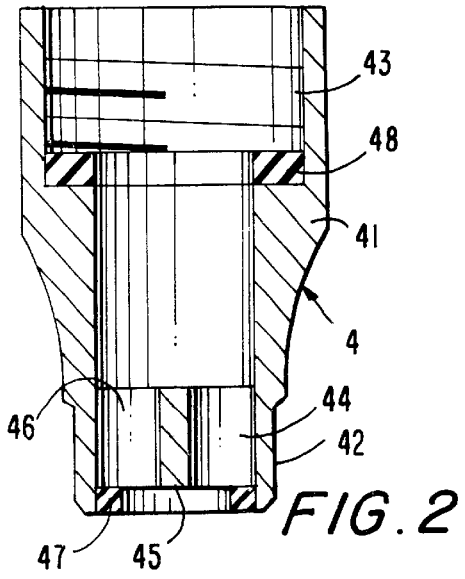
FIG. 2 shows a first embodiment of the adaptor according to the invention.
Figure 3:
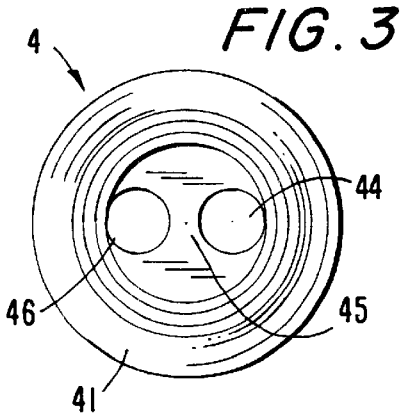
FIG. 3 is a plan view of the adaptor of FIG. 2.

The FIGS. 2 and 3 show a first embodiment of the adaptor according to the present invention. FIG. 3 is a plan view of the adapter of FIG. 2. The adaptor 4 is comprised of a rigid housing 41 with a reservoir connector 42 and reservoir seal 47 as well as a container connector 43 with a container seal 48. Between the two connectors 42 and 43 a rigid valve stop 45 is arranged which is axially penetrated by a filling channel 44 and an air channel 46.

This adaptor 4 is suitable, in particular, for connecting two rigid containers and/or reservoirs as illustrated in FIGS. 4 and 5 and described in the following with reference to these drawings.

FIG. 4 shows a first filling arrangement according to the invention before the filling process in the "assembly position" M, wherein in a refill container 3, respectively, within its rigid container wall 31, the refill medium 300 is contained. The container connector 43 of the adaptor 4 is secured by a screw connection to the container connecting piece (mouthpiece) 33 of the refill container 3 in the first assembly step m1, while in a second assembly step m2 the empty ink reservoir 2 is fastened to the reservoir connector 42 by a seal-tight plug connection. This results also in the opening of the closure or filling valve 24 arranged at the ink reservoir 2.

FIG. 5 represents the subsequent filling position F of the arrangement according to FIG. 4. Accordingly, the complete assembled arrangement has been rotated from the assembly position M by 180° into the filling position F, i.e., the refill arrangement has been turned upside down. This takes place after the adaptor 4 has been previously fastened, i.e., still in the assembly position M, via its container connector 43 to the container connecting piece (mouthpiece) 33 and, subsequently, the reservoir connecting piece (mouthpiece) 23 has been fastened to and tightly sealed in the reservoir connector 42, this also resulting in the opening of the closure or filling valve 24. The refill medium, i.e., the ink 300, contained in the refill container 3 then flows through the filling valve 24, opened by the valve stop 45, and through the filling channel 44 into the ink reservoir 2. The air contained initially in the empty ink reservoir 2 is displaced and moved through the air channel 46 into the refill container 3 which empties more and more. Neither the rigid container wall 31 nor the rigid wall of the reservoir housing 21 change their shape during this fluid exchange. When the ink reservoir 2 and the refill container 3 have the same size, i.e., practically the same container volume, both containers can be connected without problems to form a closed system without any communication with the ambient atmosphere.

In FIG. 6 a further refill arrangement of a second embodiment of the present invention is shown in its filling position F. A refill container 30 is connected to a container fastener 32 vertically above the ink reservoir 20, that is already partially filled with ink 300 and has a flexible reservoir envelope 210 which is protected by a protective enclosure 22 against damage. The refill container 30 is still partially filled with ink 300. The refill medium (ink) 300 flows from the highly flexible container envelope 310 through the adaptor 40 and through the connecting line 5 by gravity feed into the ink reservoir 20. The connecting end 51 of the connecting line 5 securely connects the connecting line 5 to the flexible reservoir envelope 210, while the other end of the connecting line 5 is provided with a closure valve 52 that ensures that in the coupled state air cannot enter the system. Adaptor 40 is fastened with one end to the container connecting piece (mouthpiece) 33 and engages with the other end the closure valve 52 in a seal-tight manner. The device and arrangement represented in FIG. 6, like the first embodiment of FIGS. 2 through 5, operates without pressure, i.e., only with gravity feed for the ink 300. Neither the flexible reservoir envelope 210 nor the also highly flexible container envelope 310 contain any air. The volume reduction caused by ink flowing out of the refill container 30 contracts the container envelope 310, while the receiving volume of the reservoir envelope 210 is enlarged by the same volume.

Figure 7:
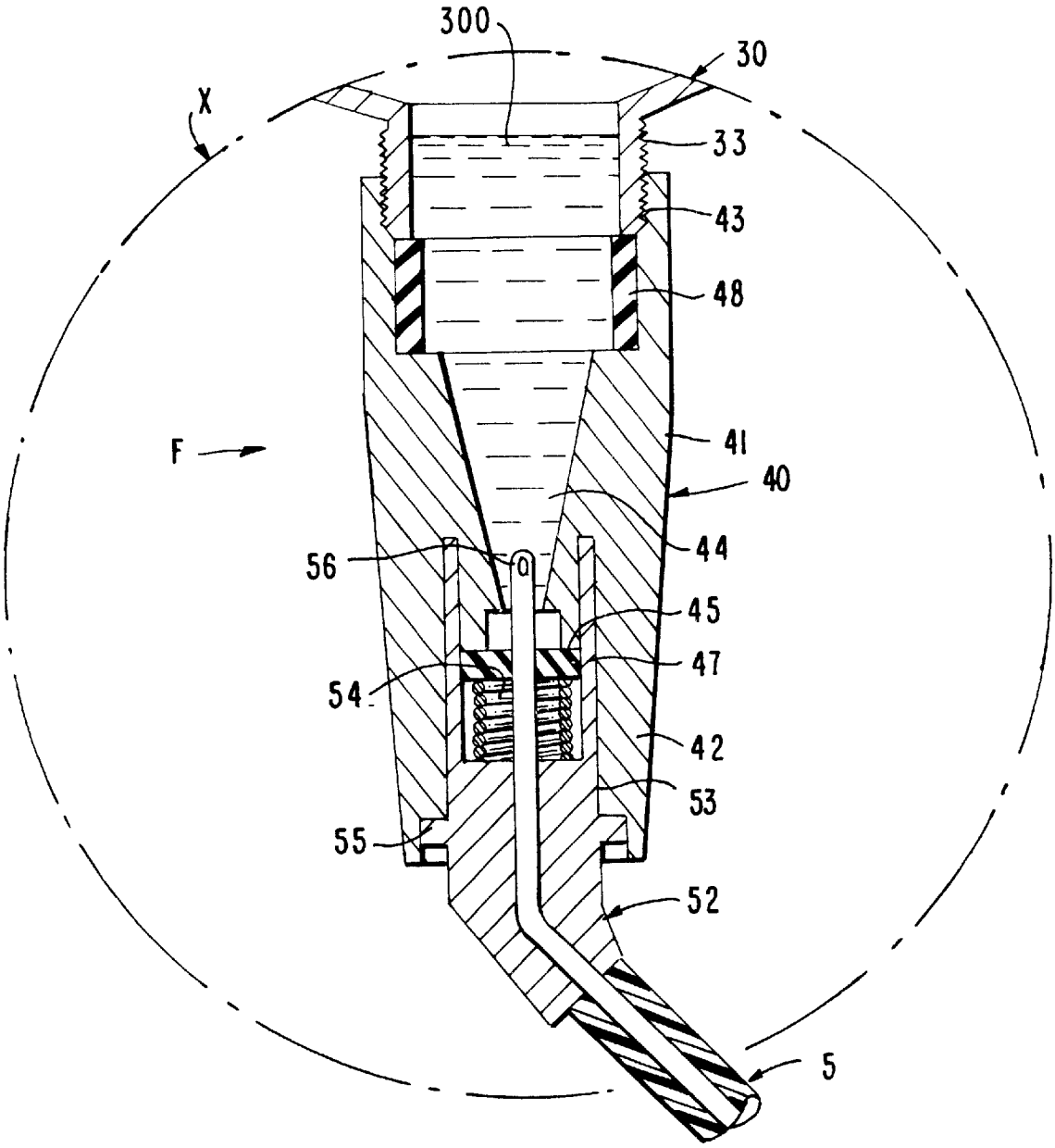
FIG. 7 shows the detail X of FIG. 6 illustrating a second embodiment of an adaptor according to the present invention in the filling position with the closure valve coupled to the adaptor.

FIG. 7 shows on a larger scale the detail X of FIG. 6 of the second embodiment of an adaptor (40) according to the invention with coupled closure valve 52 in the filling position F. This adaptor 40 can be employed in the second embodiment of the refill arrangement as shown in FIG. 6. The refill container 30 is screwed via its container connecting piece 33 (mouthpiece) to the container connector 43 of the adaptor 40 and is sealed air-tightly by a container seal 48. The other end of the rigid housing 41 of the adaptor 40 is provided with a reservoir connector 42, and the closure valve 52 connected to the connecting line 5 is fastened to the reservoir connector 42 by the reservoir connecting piece 53 with bayonet closure 55 and fixed in its position by a valve spring 54. The reservoir seal 47 is pressed against the valve stop 45 so that valve inlet 56 projecting into the filling channel 44 is released or opened. Ink 300 can thus flow from the refill container 30 via the connecting line 5, or via a direct coupling provided in place of the connecting line, into the reservoir 2, 20 (not shown in FIG. 7) or directly into the ink storage device (11) of a write head (1). Even when the valve inlet 56 is very small, e.g. only 1 $mm^2$, a sufficient ink flow from the container into the reservoir is ensured.

The device and arrangement according to the present invention for filling an ink reservoir of an automtaic writign system, especially an ink reservoir of inkjet systems, a plotter or other automatic recording, writing or drawing devices, have a refill container connected by an adaptor to the ink reservoir. In the filling position the containers are substantially arranged above one another. The adaptor has at least one housing and two connectors for receiving the container and reservoir to be connected. In this context it is especially advantageous when the ink reservoir 2, 20, the refill container 3, 30, and the adaptor 4, 40 form a hermetically closed system in the assembled state that has no connection to the ambient atmosphere.

Such a closed system can operate with air or substantially air-free, wherein an operation with air contained therein is suitable especially when the containers have solid walls, while the system operates preferably without air when the container envelopes are flexible and/or elastic so that, depending on the degree of filling, they collapse and contract or move apart and expand. In the filling position F the filling process is realized by gravity feed of the ink, respectively, pressureless or under vacuum, wherein "pressureless" is to be understood in the context of the present invention as meaning without additional pressure application and "under vacuum" is to be understood as meaning a possibly weak suction effect which can be provided, for example, by a leaf spring resting against the exterior of the flexible reservoir envelope 210 and acting on this envelope so as to expand it according to the degree of filling.

Preferably, the adaptor 4 should have at least one filling channel 44 and one valve stop 45 as well as seals 47, 48 which during filling will seal both connecting pieces (mouthpieces) 23, 33 of the reservoir and the container, respectively.

The adaptor 4 should have a stable, rigid housing 41 so that the connections of the containers are maintained safely and air-tightly even during filling.

The ink reservoir 2 and the refill container 3 according to a first variation can be made of a rigid material, preferably a rigid synthetic (plastic) material or metal.

In the alternative, the ink reservoir 2 can be made of a rigid plastic material or metal, and the refill container 30 can be made of flexible and/or elastic material.

In systems which operate substantially pressureless and are void of air, it is especially advantageous when the ink reservoir 20 as well as the refill container 30 are comprised of flexible and/or elastic material, preferably a highly flexible polymer material. These systems fill surprisingly well and allow several uses of these high quality disposable parts by allowing additional refilling actions.

In order to avoid soiling and accidental air flow in and out of the system, it is especially advantageous when the adaptor 4 has seals 47, 48 in the form of annular disks or O-rings made of rubber or a soft plastic material.

In order to construct the respective connections so as to be reliable, the connectors 42, 43 at the housing 41 of the adaptor 4, 40 for the reservoir 2, 20 and the container 3, 30 should be in the form of threaded connectors, frictional plug connectors or positive-locking bayonet connectors.

In order to prevent air from entering the system before and during assembly, so that ink leaks are prevented, it is advantageous when the closure valves provided in the system, e.g., the closure and filling valve 24 and/or the closure valve 52, are forced open only upon attachment of the reservoir 2, 20 and the container 3,30 or the connecting line 5. This occurs automatically when making the flange connection.

In a preferred device and arrangement for refilling an ink reservoir, especially an ink reservoir of an inkjet system, a plotter or other automatic recording, writing or drawing devices, in which two containers are to be connected by an adaptor, the adaptor 40 has a housing 41, at least one reservoir connector 42 and a container connector 43 for the refill container 30 and the reservoir 22 to be connected and at least one filling channel 44 and a valve stop 45. Furthermore, seals 47, 48 are provided which in the filling position F, respectively, during filling, tightly seal the reservoir connecting piece (mouthpiece) 23 or the reservoir connecting piece (mouthpiece) 53 provided at the closure valve 52 and the container connecting piece (mouthpiece) 33.

An especially effective refill unit results when the ink reservoir 20 has a flexible reservoir envelope 210 and the refill container 30 has a flexible container envelope 310 and when the reservoir 20 and the container 30 are seal-tightly connected to one another by adaptor 40.

If needed, a connecting line 5 can be arranged at the ink reservoir 20 which is connected by a connecting end 51 to the ink reservoir 20 and has at its opposite end a closure valve 52 which is fastened seal-tightly to the adaptor 40 and is thus connected to the refill container 30.

Preferably, the adaptor 4, 40 is fastened to the refill container 3, 30 before the filling process and/or before the connection to the closure valve 52 is established.

An especially advantageous arrangement for refilling an ink reservoir, respectively, an ink storage device of an inkjet system, a plotter, or other automatic recording, writing or drawing devices, wherein an ink reservoir and a refill container are connected by In adaptor, is provided when the refill container 3, 30 in the filling position F is arranged substantially above the filling level of the ink reservoir 2, 20. Preferably, i.e., depending on the length of the connecting line, the refill-container 30 in the filling position F should be 20 to 50 cm above the ink reservoir 20 so that a favorable gravity-based pressure differential results for establishing gravity feed.

It was found that highly flexible polymer bags are especially suitable as container envelopes 310 of the refill containers 30. When positioned above the level of the ink reservoir 20, which may have been removed from the automatic writing system, and mounted such that the container connecting piece (mouthpiece) 33 points downwardly, the ink 300 flows by gravity feed into the ink reservoir 20. The polymer bag or container envelope 310 will collapse during this process and the ink bag, respectively, the flexible reservoir envelope 210 of the ink reservoir 20 is filled in a few minutes without pressure loading simply by gravity feed. Air compensation is not required because the system operates without air and therefore does not require any air compensation system. Gravity feed moves the ink from one bag into the other which is positioned lower. The system thus functions surprisingly simply and reliably.

While specific embodiments of the invention have been shown and described in detail to illustrate the inventive principles, it will be understood that the invention may be embodied otherwise without departing from such principles.

What is claimed is:

1. A refill arrangement for an ink reservoir of an automatic writing system, the refill arrangement comprising:

an ink reservoir, an adaptor, and a refill container provided as individual parts configured to be combined for filling the ink reservoir such that the adaptor connects the refill container to the ink reservoir and such that the refill container, the adaptor, and the ink reservoir are hermetically sealed relative to the ambient atmosphere when connected;

wherein the refill container is positioned vertically above the ink reservoir in a filling position of the refill arrangement; and wherein the refill arrangement is configured such that in the filling position refilling occurs pressureless or by gravity feed.

2. The refill arrangement according to claim 1, wherein the adaptor has one or more first connectors configured to receive a connecting piece of the ink reservoir and one or more second connectors configured to receive a connecting piece of the refill container, wherein the adaptor has at least one filling channel connecting the first and second connectors, and wherein the adaptor has a valve stop and seals configured to seal the connecting pieces relative to the adaptor, respectively.

3. The refill arrangement according to claim 2, wherein the seals are made of rubber or a soft synthetic material and are annular discs or O-rings.

4. The refill arrangement according to claim 2, wherein the first and second connectors are selected from the group consisting of a thread connector, a frictional plug connector, and a positive-locking bayonet connector.

5. The refill arrangement according to claim 1, wherein the adaptor has a rigid housing.

6. The refill arrangement according to claim 1, wherein at least one of the ink reservoir and the refill container is made of a rigid material.

7. The refill arrangement according to claim 1, wherein the ink reservoir and the refill container are made of a rigid synthetic material.

8. The refill arrangement according to claim 7, wherein the refill container is made of a material selected from the group consisting an elastic material, a flexible material, and an elastic, flexible material.

9. The refill arrangement according to claim 1, wherein the ink reservoir and the refill container are made of metal.

10. The refill arrangement according to claim 1, wherein the ink reservoir is made of a rigid synthetic material or metal.

11. The refill arrangement according to claim 1, wherein the ink reservoir and the refill container are made of a material selected from the group consisting of an elastic material, a flexible material, and an elastic, flexible material.

12. The refill arrangement according to claim 1, wherein the ink reservoir and the refill container are made of a highly flexible polymer material.

13. The refill arrangement according to claim 1, comprising closure valves, provided at one or more of the ink reservoir, the adaptor, and the refill container and configured to be opened when the ink reservoir and the refill container are connected to the adaptor.

14. A refill arrangement for an ink reservoir of an automatic writing system, the refill arrangement comprising an ink reservoir, an adaptor, and a refill container, wherein the adaptor is configured to connect the ink reservoir and the refill container to one another so as to be hermetically sealed relative to the ambient atmosphere in a filling position for filling the ink reservoir and wherein in the filling position refilling occurs pressureless or by gravity feed, wherein the adaptor has a housing, one or more first connectors arranged in the housing and configured to receive a connecting piece of the ink reservoir, and one or more second connectors arranged in the housing and configured to receive a connecting piece of the refill container, wherein the housing has at least one filling channel connecting the first and second connectors, wherein the adaptor has a valve stop and seals configured to seal the connecting pieces in the respective first and second connectors during refilling.

15. The refill arrangement according to claim 14, wherein the ink reservoir comprises a flexible reservoir envelope and the refill container comprises a flexible container envelope.

16. The refill arrangement according to claim 14, wherein the ink reservoir comprises a connecting line and wherein the connecting piece of the ink reservoir is provided at an end of the connecting line remote from the ink reservoir, wherein the connecting piece comprises a closure valve and the connecting piece with the closure valve is connected to the first connector of the adaptor.

17. A refill arrangement for an ink reservoir of an automatic writing system, the refill arrangement comprising an ink reservoir, an adaptor, and a refill container, wherein the adaptor is configured to connect the ink reservoir and the refill container to one another so as to be hermetically sealed relative to the ambient atmosphere in a filling position for filling the ink reservoir and wherein in the filling position refilling occurs pressureless or by gravity feed, wherein the adaptor is a component separate from the refill container and the ink reservoir, and wherein the refill container in a filling position of the refill arrangement is positioned vertically above the ink reservoir.

18. The refill arrangement according to claim 17 wherein the refill container is positioned 20 cm to 50 cm above the ink reservoir in the filling position.

* * * * *